US008011141B1

(12) United States Patent
Petricio Yaksic

(10) Patent No.: US 8,011,141 B1
(45) Date of Patent: Sep. 6, 2011

(54) CONICAL ROOF CONSTRUCTION

(76) Inventor: Davor Petricio Yaksic, Antofagasta (CL)

( * ) Notice: Subject to any disclaimer, the term of this patent is extended or adjusted under 35 U.S.C. 154(b) by 0 days.

(21) Appl. No.: 12/803,367

(22) Filed: Jun. 25, 2010

Related U.S. Application Data

(62) Division of application No. 10/956,351, filed on Oct. 4, 2004, now Pat. No. 7,743,582.

(51) Int. Cl.
*E04B 7/08* (2006.01)
*E04B 7/00* (2006.01)

(52) U.S. Cl. ..... 52/82; 52/192

(58) Field of Classification Search ..... 52/82, 91.1, 52/91.3, 192, 745.06; 220/565, DIG. 29
See application file for complete search history.

(56) References Cited

U.S. PATENT DOCUMENTS

| | | | | | |
|---|---|---|---|---|---|
| 1,096,442 | A * | 5/1914 | Martin | 52/19 |
| 1,267,679 | A * | 5/1918 | McGaffee | 52/82 |
| 1,907,268 | A * | 5/1933 | Schwemlein | 220/693 |
| 2,073,358 | A * | 3/1937 | Williamson | 52/82 |
| 2,288,809 | A * | 7/1942 | Larkin et al. | 52/82 |
| 2,356,768 | A * | 8/1944 | Ladon | 52/82 |
| 2,357,705 | A * | 9/1944 | Thorne | 454/177 |
| 2,395,685 | A * | 2/1946 | Schmitz, Jr. | 220/565 |
| 2,751,672 | A * | 6/1956 | Reed | 29/429 |
| 2,766,707 | A * | 10/1956 | Foster et al. | 52/82 |
| 2,775,794 | A * | 1/1957 | Keely | 52/82 |
| 3,281,999 | A * | 11/1966 | Lebson et al. | 52/82 |
| 4,192,107 | A * | 3/1980 | Wickstrom et al. | 52/82 |
| 4,714,170 | A * | 12/1987 | Scott | 220/565 |
| 6,698,143 | B2 * | 3/2004 | Jensen et al. | 52/82 |
| 7,743,582 | B1 * | 6/2010 | Petricio Yaksic | 52/745.06 |
| 2003/0217520 | A1 * | 11/2003 | Jensen et al. | 52/82 |
| 2005/0108956 | A1 * | 5/2005 | Cote et al. | 52/90.1 |

* cited by examiner

*Primary Examiner* — Robert J Canfield
(74) *Attorney, Agent, or Firm* — James Creighton Wray

(57) ABSTRACT

A new conical roof building method provides flat plates having straight abutting edges and curved outer edges. The plates are placed horizontally edge to edge except for a sectoral opening. The plates are welded together to form a flat disc-shaped blank, leaving an open sector of the blank. Radial supports are welded to a top of the disc-shaped blank. A center of the disc-shaped blank is lifted, forming a conical-shaped structure, closing and abutting edges of the open sector and touching edges of the formerly open sector are welded together, completing the forming of the conical roof.

8 Claims, 8 Drawing Sheets

CONICAL ROOF CONSTRUCTION

This application is a division of U.S. patent application Ser. No. 10/956,351 filed Oct. 4, 2004, now U.S. Pat. No. 7,743, 582, which is hereby incorporated by reference in its entirety as if fully set forth herein.

BACKGROUND OF THE INVENTION

Placing roofs on large storage tanks and large circular structures is a difficult task which requires constructing and erecting support scaffolding to great heights above the ground and cutting, forming and building supports and plates at precise angles and constructing a precisely shaped supporting frame under the roof before welding of the roof elements together. The construction of domed and conical roofs requires a large amount of time, expense and skilled labor. In many cases support frames must be left enclosed within the roofs.

Roofs are constructed atop buildings far from the ground. Tall scaffolding and extra precautions and safety procedures are required.

Needs exist for better roof constructions.

SUMMARY OF THE INVENTION

A new conical roof building method provides flat plates having straight abutting edges and curved outer edges. The plates are placed horizontally edge to edge except for a sectoral opening. The plates are welded together to form a flat disc-shaped blank, leaving an open sector of the blank. Radial supports are welded to a top of the disc-shaped blank. A center of the disc-shaped blank is lifted, forming a conical-shaped structure, closing and abutting edges of the open sector and touching edges of the formerly open sector are welded together, completing the forming of the conical roof.

The plates are initially supported on a table structure. Curved outer edge portions of the plates are supported on a shell ring before and during welding of the plates together in a flat form and welding of the radial supports to the top of the disc-shaped blank with the open sector.

The blank and the conical-shaped structure are supported on upper edges of the shell ring during the lifting of the center of the disc-shaped blank and the transitioning and transforming of the blank into a conical-shaped roof, and the securing of abutting edges of the open sector.

The completed conical roof is supported on the circular upper edge of the shell ring.

The conical roof is welded inside and outside along its intersections with the upper edges of the shell ring.

The securing edges of the open sector preferably include welding the abutting edges of the sector together. Before welding and securing the edges together, bridging strips are welded across the abutting edges of what formerly was the open sector.

A compression ring is welded to upper and inward portions of the radial supports after competing the forming of the conical roof. The compression ring takes some of the compressive load around the central opening in the conical roof.

In a preferred embodiment, before and during welding abutted edges of the flat plates together, the beveled edges of the plates are supported on thin copper strips on scaffolds beneath the edges, and the welding is accomplished by welding machines that move over the to of the flat plates.

In another preferred embodiment, centers of the plates are supported on plural parallel tables and outer curved edge portions of the plates are supported on a circular upper edge of a shell ring before and during welding of the plates together and welding of the radial supports to the top of the disc-shaped blank.

The welding of the radial supports to the top of the disc-shaped blank is accomplished by welding lower edges of angle iron vertical flanges at intervals to the top of the disc-shaped blanks. After completing the forming of the conical roof, the entire edges of the vertical flanges of the angle iron radial supports are fully welded on the conical surfaces of the conical roof.

Preferably, a central opening is provided in a center of the blank. In large roofs alternate radial extend from the central opening to the outer curved edge of the blank. Alternate intermediate supports extend from the outer edge of the blank to positions spaced from the central opening.

To form the conical shape, the center of the blank is lifted with an element connected to a lifting ring on a bolt extending through the central opening. Usually, the center of the blank is lifted with a crane attached to the lifting ring. The center of the blank may be lifted into a cone shape by extending a vertical ram positioned under the center of the blank.

A preferred conical roof structure has a conical plate with a central opening and a welded seam running from a lower outer edge of the conical plate to a center of the conical plate. Plural radial supports are welded to the conical plate, and a compression ring is welded to upper surfaces of inward portions of the radial supports around a center of the cylindrical roof. A vent pipe is mounted in the central opening.

The radial supports alternate in running from an outer edge of the conical plate to the central opening, and running from an outer edge of the conical plate to positions spaced from the central opening.

The roof is self-supporting, and an area inward on an underside of the plate near the curved outer edge is supported on an upper edge of a roof support shell ring.

Because of the unusual construction of the new conical roof, the roof may be assembled in a short time with the welding of precut sheets and supports in a flat condition, followed by reinforcing the sheets with radial supports welded to the sheets at intervals. Lifting the center of the roof vertically closes an open sector. Completion of the welding of the former sector edges and the supports on the sheets completes the roof. Welding of the inner and outer circular joints between the upper edge of the support ring and the lower inward surface of the conical roof along circles spaced inward from the outer edge completes the joining of the roof to the underlying structure. The unique construction of the roof is accomplished with a fraction of the cost and time associated with constructing a conical or domed roof on a large circular structure. The new roof is constructed with straight welding.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
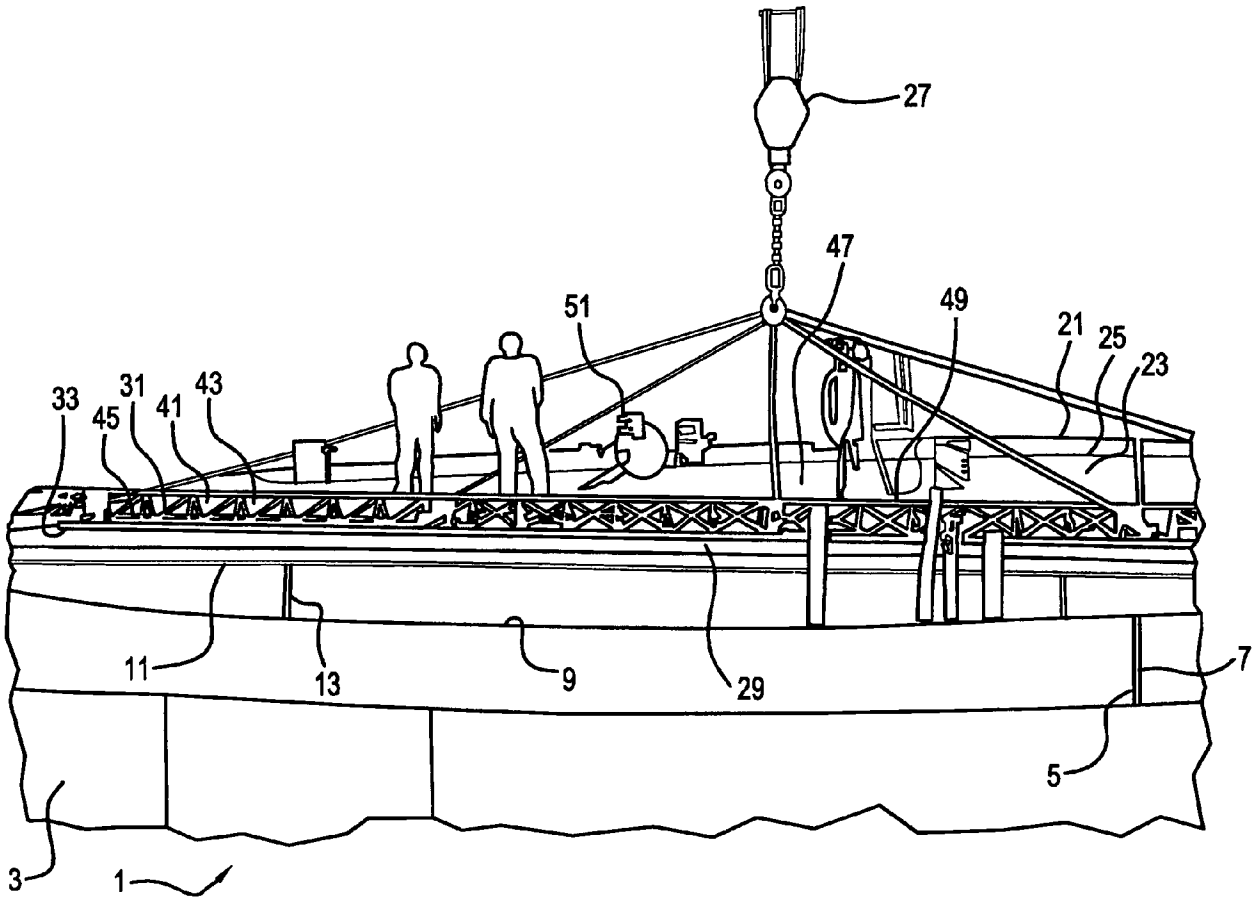
FIG. 1 shows a cylindrical ring shell and internal tables for supporting a flat plate of a roof while it is being assembled and constructed from welded parallel plates. The crane and lifting truss is shown placing a plate in position on the supporting table for subsequent welding to the longitudinal edge of the plates already assembled at the rear of the drawing.

FIG. 1 shows a cylindrical ring shell and internal tables for supporting a flat plate of a roof while it is being assembled and constructed from welded parallel plates. The crane and lifting truss is shown placing a plate in position on the supporting table for subsequent welding to the longitudinal edge of the plates already assembled at the rear of the drawing.

As shown in FIG. 1, a cylindrical support structure with a circular upper edge is first constructed by welding curved plates in vertical welds at longitudinal ends of the curved plates.

The cylindrical ring shell is generally indicated by the numeral 1 and is formed from a series of vertical plates 3 which are curved around a vertical axis. Vertical welds 7 join longitudinal end edges 5 of the plates. A circular upper edge 9 of the cylindrical support shell supports the roof Tables 11 with legs 13 are mounted inside the cylindrical ring shell 1 to support the elongated roof plates 23 as they are assembled and welded along their longitudinally extending lateral edges 25.

FIG. 1 also shows a crane sheave 27 lowering an elongated plate 29 into position next to previously welded plates 23 shown in the back. A truss 31 has several supports 33 for holding the longitudinally extending plate 29 as it is placed in position. A sectoral opening 41 with radial side edges 43 and 45 is left open when forming the flat roof plates. A central opening 47 is formed in the middle plate and has a welded collar 49 for receiving a lifting assembly during construction and holding a vent pipe after construction. Welding machines 51 may be used to weld the joints 25 between abutting lateral edges of the plates 23.

Figure 2:
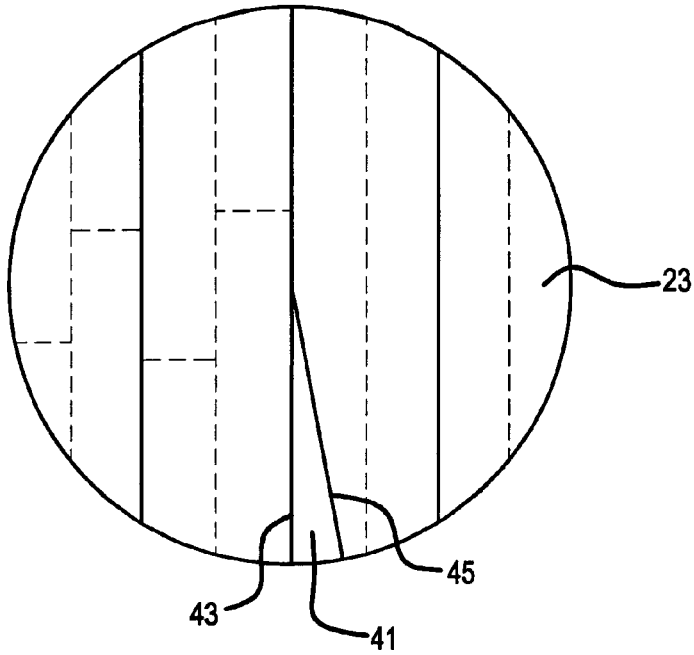
FIG. 2 is a top plan of the support ring shell and the tables before the roof plates are placed.

FIG. 2 is a plan view of the assembled and welded roof shells or plates 23 showing open sector 41 with edges 43, 45.

Figure 3:
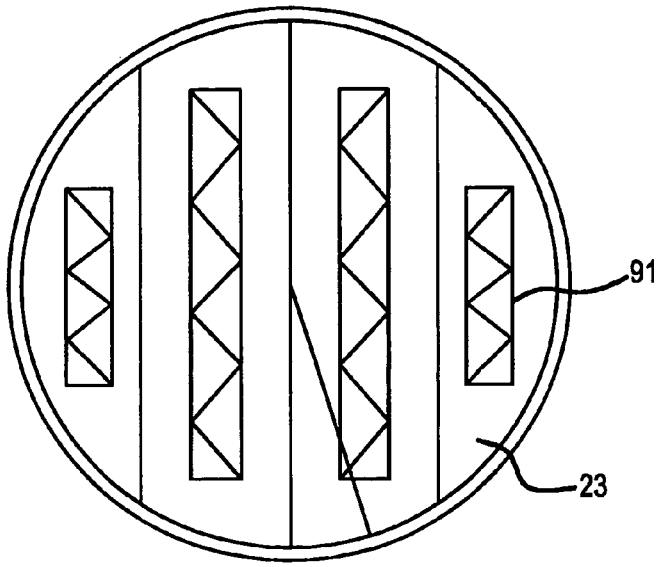
FIG. 3 is a plan view of tables supporting the plates during assembly of the flat blank.

FIG. 3 is a top plan view of the welded roof plates or sheets supported by the support ring shell, and the support tables 91 put in place before the roof plates 23 are placed and edges are welded.

Figure 4:
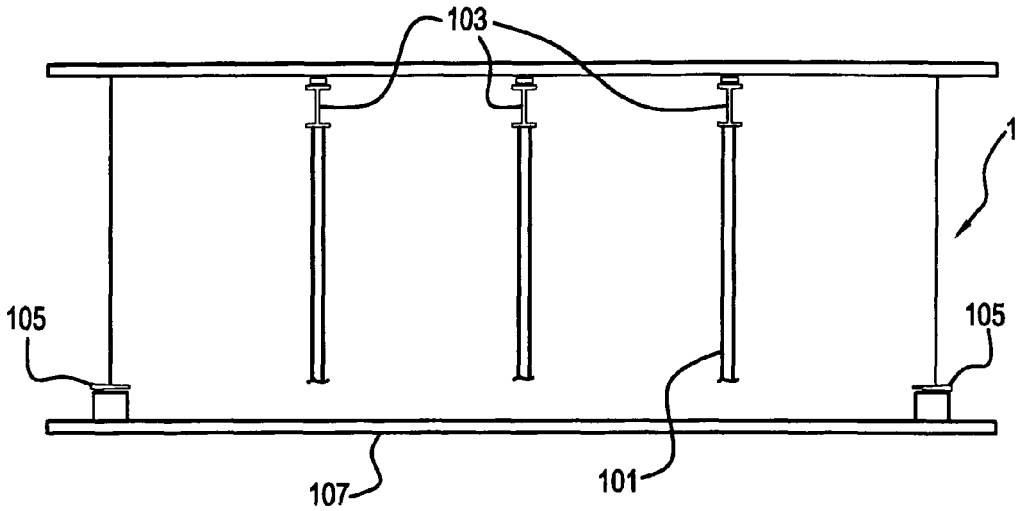
FIG. 4 is an elevation of scaffolds with I beams and shims for supporting seams before and during welding.

FIG. 4 shows preferred supports 101 with upper I beams 103 and leveling shims or wedges 105 to support plate seams. The ring shell 1 is shown mounted on a concrete base 107. Ring shell 1 also supports the plates.

Figure 5:
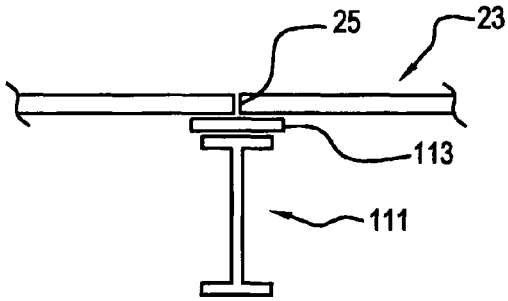
FIG. 5 is a detail of a scaffold supporting a seam being welded.

FIG. 5 is a detail of an I beam 111 on top of a support. Wedges 105 hold a copper strip 113 against an inside of edges 25 of plates 23 before and during welding.

Figure 6:
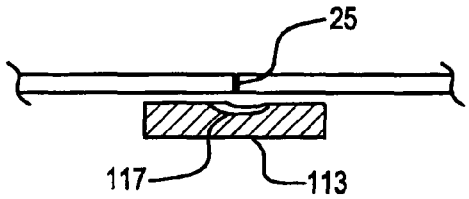
FIG. 6 is a cross sectional detail of a copper strip below a seam being welded.
Figure 7:
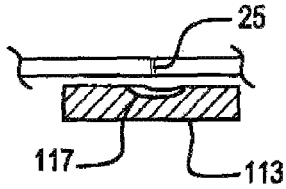
FIG. 7 is an enlarged cross sectional detail of edges and a copper strip before welding.

FIG. 6 is a detail of the copper strip 113 with a groove 117 beneath the seam edges 25. The copper strip 113 is about ⅜" thick and about 2" wide, as shown in FIG. 7. Sheet edges 25 are beveled 119 so that the welding may be done from the flat top of the assembled sheets 23. The copper strip assures complete fusing of the edges 25.

Figure 8:
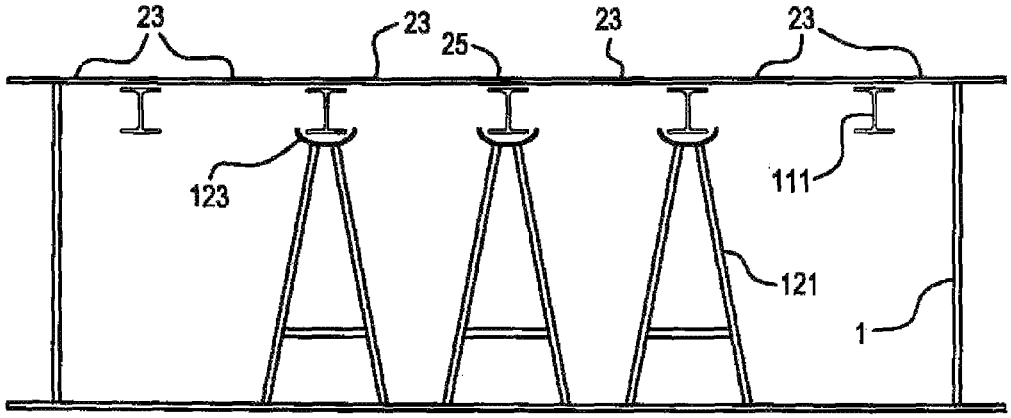
FIG. 8 is a side view of scaffolds and seam supports.
Figure 9:
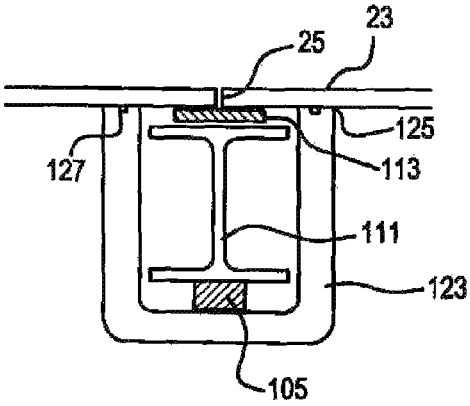
FIG. 9 is a detail of preferred seam supports.

FIGS. 8 and 9 show a different seam support 121 with u-shaped support tops 123 for holding the I beams 111 against the copper strip 113 with the aid of wedges 105 for precise welding. Tops 125 of the U's may be spot welded 127 to the roof sheets 23 to hold the edges 25 together during their welding. The support ring shell is shown supporting the edges of the flat roof structure.

Figure 10:
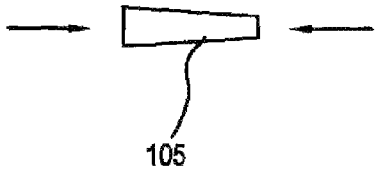
FIG. 10 is a detail of a wedge or shim used to finely adjust the support.

FIG. 10 shows a shape of one possible wedge 105.

Figure 11:
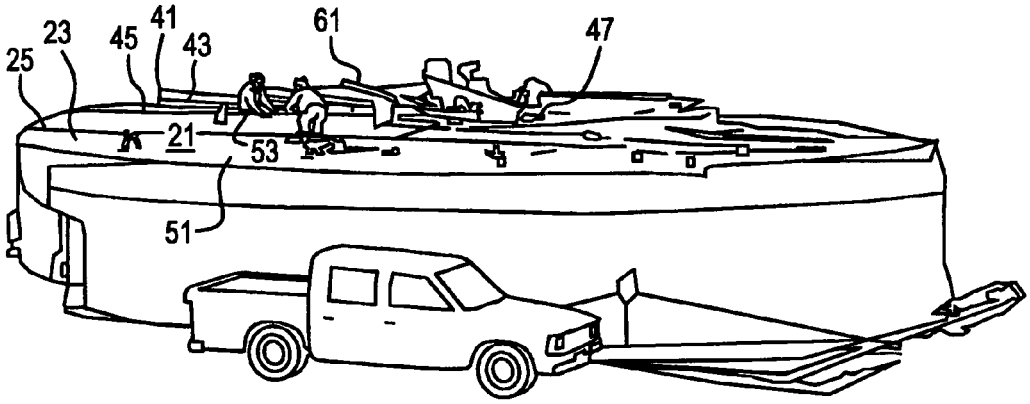
FIG. 11 shows the roof plates being assembled and welded, with the last plate shown being positioned by a crane. A sector with radial edges that extend from the central opening to the outer edge of the roof plate is left open, as shown at the left.

FIG. 11 shows the roof plates 23 being assembled and edges 25 being welded, with the last plate being positioned by the crane. A sector with radial edges 43, 45 that extend from the central opening 47 to the outer edge of the roof plate is left open, as shown at the left.

As shown in FIG. 11, the flat plate blank 21 is fully assembled with the lowering into place of the last curved edge plate 51. The sector 41 has been left open with spaced radial edges 43 and 45, as indicated by the person 53 who is standing within the open sector.

The open sector 41 extends to the central opening 47. Radial supports 61 have been provided for radially arranging on the flat roof plate 21.

Figure 12:
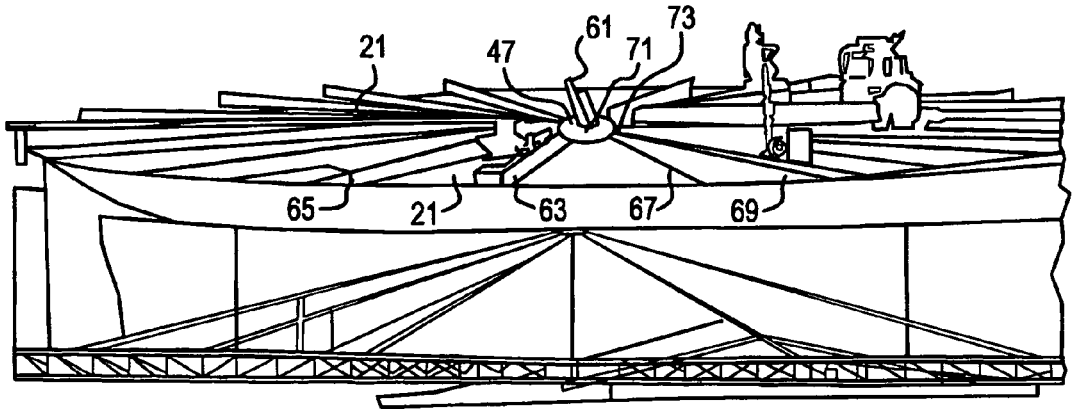
FIG. 12 shows the welding of bottom edges of vertical flanges of radial angle iron support beams to the plate. The support beams are welded at intervals to the plate. The support beams extend inward from the outer edge. Alternating support beams extend to the central opening and to positions spaced from the central openings.

FIG. 12 shows the welding of bottom edges of vertical flanges of radial angle iron support beams to the plate. The support beams are welded at intervals to the plate. The support beams extend inward from the outer edge, and alternating support beams extend to the central opening 47 and to positions spaced from the central opening.

As shown in FIG. 12, the radial supports 61 have all been welded in place on the roof plate 21 by interval welding at the lower edge of vertical flanges 63 of the angle iron supports 61. Outer ends 65 of the angle iron supports extend to the outer edge of the flat plate 21. Alternate supports 67 and 69 have inner edges 71 and 73. The inner edges 71 of the long supports 67 extend to the central opening 47. The inner edges 73 of the shorter supports 69 extend to positions spaced from the central opening.

Figure 13:
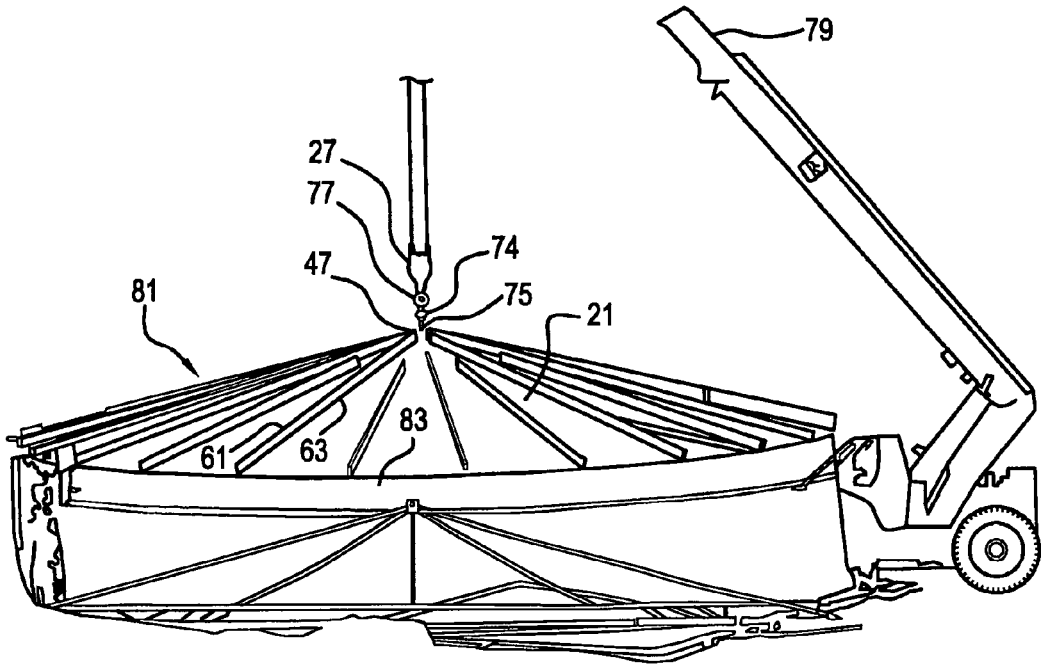
FIG. 13 shows the lifting of the center of the roof plate, which causes closing of the sectoral opening. The sector edges are abutted and are held abutted by bridge plates welded across the edges. Then the edges are welded together. At all times the outer edge portion of the roof plate in both its preliminary flat form and in its conical assembled form is supported by the upper edge of the support ring shell.

FIG. 13 shows the lifting of the center 47 of the roof plate 21, which causes closing of the sectoral opening 41. The sectoral opening edges 43, 45 are abutted and are held abutted by bridge plates welded across the edges 43, 45. Then the edges 43, 45 are welded. At all times the outer edge portion of the roof plate in both flat 21 and conical 81 forms is supported by the upper edge of the support ring shell.

As shown in FIG. 13, a hook-lifting ring 74 has been secured in the central opening by extending the shaft 75 of the o-ring 74 through the central opening 47 and attaching a plate beneath the central opening with a nut. A hook 77 on sheath 27 of crane 79 lifts the ring and forms the roof into its finished conical shape 81. During the lifting of the center of the roof, a circular inner portion of the roof spaced inward from the outer edge 83 rests on the upper edge of the cylindrical wall 1. Lifting the center of the roof closes the sectoral opening 41 shown in FIGS. 1 and 2. The abutting radial edges of the closed sector are bridged with steel strips that are welded in place, and then both radial edges 43 and 45 are welded together. The lower edges of the vertical flanges 63 of the radial supports 61 are welded continuously to the roof plate surface 81 on both sides of the flanges 63. The joint of the conical roof 81, with the circular upper edge of the cylindrical support wall, is welded inside and outside.

Figure 14:
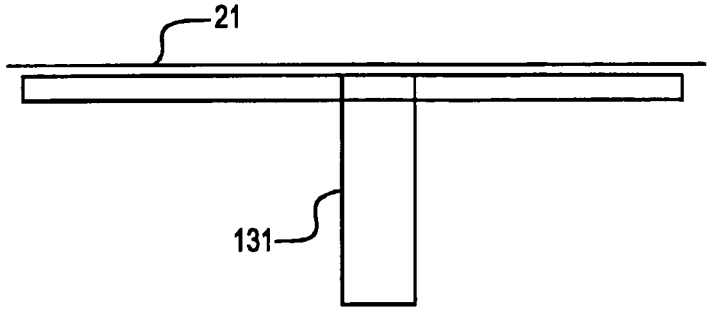
FIG. 14 shows the center being lifted by pushing with an internal ram rather than by pulling with an external crane.

FIG. 14 shows lifting the center of the flat roof 21 with a ram 131.

Figure 15:
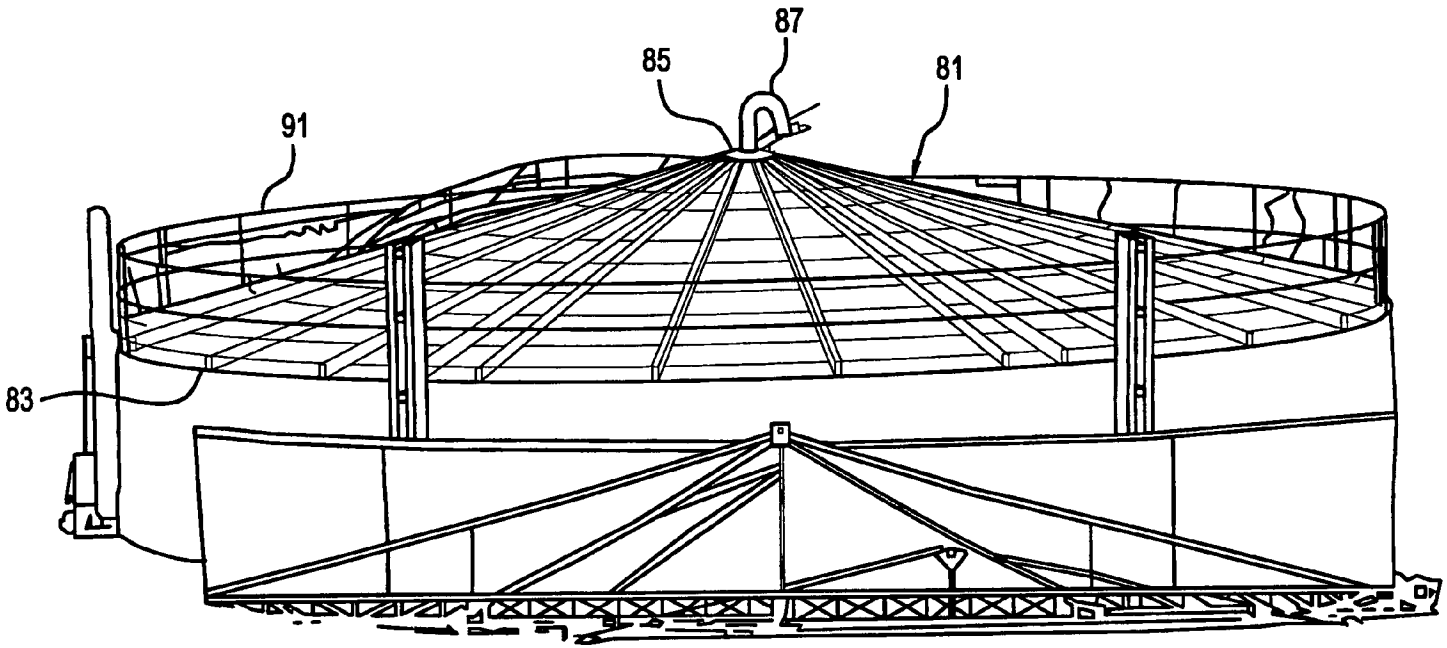
FIG. 15 shows the addition of a compression ring on the inside end portions of the long radial supports, and the addition of a vent pipe in the central opening. A safety railing is being installed around the periphery of the roof. A lower outer portion of the roof is welded to the upper edge of the cylindrical support shell, both on the inner surfaces at the upper edge and the outer surfaces of the upper edge.

FIG. 15 shows the addition of a compression ring 85 on the inside end portions 71 of the long radial supports 67, and the addition of a vent pipe 87 in the central opening 47. A safety railing 91 is being installed around the periphery of the roof. The lower outer portion of the roof is welded to the upper edge of the cylindrical support shell, both on the inside surfaces of the upper edge and the outer surfaces of the upper edge.

As shown in FIG. 15, a conical compression plate 85 is welded to the upper surfaces of the angle iron supports 61 near their inner edges 71. A curved vent pipe 87 is welded to the central opening. Finally a safety railing 91 is welded along the outer edge 83 of the conical roof 81.

The assembled roof is self-supporting. The roof holds its own conical shape and is supported only by the upper edge of the cylindrical support ring 1.

Figure 16:
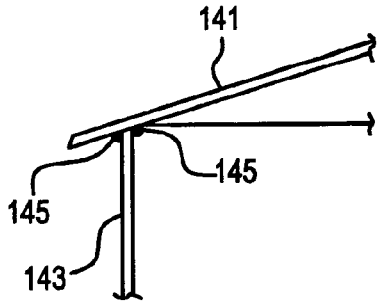
FIG. 16 is a cross sectional view of a roof and wall connection of the present invention showing welding spots.

FIG. 16 is a cross sectional view of a roof and wall connection of the present invention showing welding spots. A roof 141 is attached to side walls 143 by welding 145 the inside and outside connection between the wall 143 and roof 141.

Figure 17:
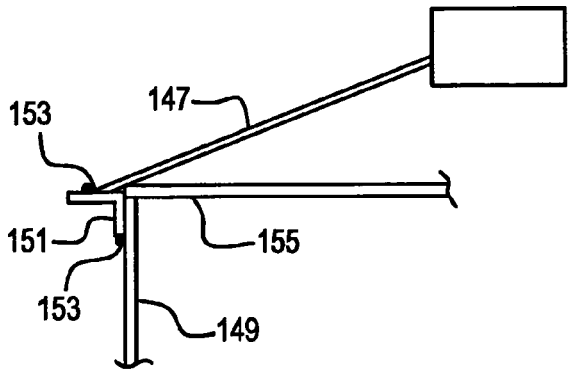
FIG. 17 PRIOR ART
FIG. 17 is a cross sectional view of a roof and wall connection from existing conical roofing showing welding spots.

FIG. 17 is a cross sectional view of a roof and wall connection from existing conical roofing showing welding spots. In prior systems, a conical roof 147 was connected to a wall 149 by use of a bracket 151 that was welded 153 to both the conical roof 147 and to the wall 149. However, this process often results in rust forming at the connection 155 between the conical roof 147 and wall 149.

Figure 18:
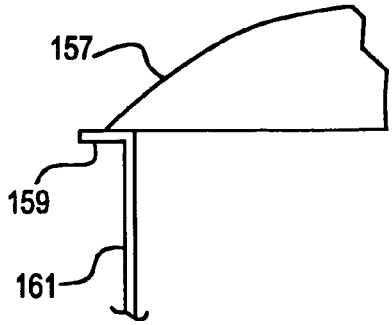
FIG. 18 PRIOR ART
FIG. 18 is a cross sectional view of a roof and wall connection from existing domed roofing showing connections.

FIG. 18 is a cross sectional view of a roof and wall connection from existing domed roofing showing connections. In prior systems, a domed roof 157 rested on top of a shelf 159 in a wall 161.

Because of the unusual construction of the new conical roof, the roof can be assembled in a short time with the welding of precut sheets in a flat condition, followed by the interval welding along lower edges of radial supports to the welded roof plates. Lifting of the center of the roof vertically closes the open sector. Bridge strips are welded across the abutted radial edges before complete welding of the edge. Completion of the welding of the radial roof support beams, adding and welding a compression ring, completes the roof. Welding inner and outer circular joints between the upper edge of the support ring 1 and circular portions of the lower surface of the conical roof 81 spaced inward from the outer edge 83 holds the roof in place.

The unique construction of the roof is accomplished with a fraction of the cost and time associated with constructing a cylindrical or domed roof on a large circular structure, and is constructed with straight welding.

While the invention has been described with reference to specific embodiments, modifications and variations of the invention may be constructed without departing from the scope of the invention, which is defined in the following claims.

The invention claimed is:

1. Apparatus comprising a conical roof, the conical roof being constructed as generally triangular plates having straight abutting edges and curved outer edges, the abutting edges of the plates being welded together and forming the conical roof, radial supports welded to a top of the conical roof, a center of the conical roof being raised to force together the abutting edges of the plates forming a conical-shaped structure, completing the conical roof, further comprising a compression ring welded to upper and inward portions of the radial supports after completing the conical roof.

2. The apparatus of claim 1, further comprising a cylindrical shell ring wherein outer portions of the plates are supported on upper edges of the cylindrical shell ring.

3. The apparatus of claim 2, wherein the conical roof is welded to the upper edges of the shell ring.

4. Apparatus comprising a conical roof, the conical roof being constructed of generally triangular plates having straight abutting edges and curved outer edges, the abutting edges of the plates being welded together and forming the conical roof, radial supports welded to a top of the conical roof, a center of the conical roof being raised to force together the abutting edges of the plates forming a conical-shaped structure, further comprising an opening in a center of the roof and the radial supports comprising alternating supports extended from the center opening to the outer curved edge of the roof and alternate intermediate supports extended from the outer edge of the roof to positions spaced from the central opening.

5. The apparatus of claim 4, having a vent pipe connected to the central opening.

6. The apparatus of claim 4, wherein the roof is self-supporting and wherein an area inward on an underside of the roof near the curved outer edge is supported on an upper edge of a roof support shell ring.

7. The apparatus of claim 4, wherein the roof is supported on a roof-support shell ring.

8. The apparatus of claim 4, further comprising a building supporting the conical roof.

* * * * *